US009044111B2

(12) United States Patent
Zox

(10) Patent No.: US 9,044,111 B2
(45) Date of Patent: Jun. 2, 2015

(54) COCKTAIL PLATE

(75) Inventor: John Zox, Philadelphia, PA (US)

(73) Assignee: Holdaplate, LLC, New York, NY (US)

( * ) Notice: Subject to any disclaimer, the term of this patent is extended or adjusted under 35 U.S.C. 154(b) by 109 days.

(21) Appl. No.: 13/135,977

(22) Filed: Jul. 20, 2011

(65) Prior Publication Data

US 2013/0020332 A1 Jan. 24, 2013

(51) Int. Cl.
*A47G 19/02* (2006.01)
*A47G 19/06* (2006.01)

(52) U.S. Cl.
CPC ..... *A47G 19/06* (2013.01)

(58) Field of Classification Search
USPC ..... 294/144, 172; 220/574, 23.4, 23.6, 694, 220/737, 575, 755; 206/564
See application file for complete search history.

(56) References Cited

U.S. PATENT DOCUMENTS

| | | | | |
|---|---|---|---|---|
| 757,645 | A | 4/1904 | Bassett | |
| 1,272,996 | A | 7/1918 | Poschadel | |
| 2,314,835 | A * | 3/1943 | Thomas et al. | 220/23.4 |
| D135,524 | S | 4/1943 | Johnstone | |
| 2,427,697 | A | 9/1947 | Weidler | |
| D154,671 | S | 8/1949 | Foley | |
| 2,582,183 | A | 1/1952 | Weidler | |
| 3,401,858 | A | 9/1968 | White et al. | |
| 3,580,484 | A * | 5/1971 | Schneider | 220/574 |
| 3,955,672 | A | 5/1976 | Brundage | |
| 4,024,590 | A * | 5/1977 | Wendt | 4/628 |
| D270,324 | S | 8/1983 | French | |
| 4,607,758 | A | 8/1986 | Stevens | |
| 4,744,597 | A | 5/1988 | Bauman et al. | |
| D307,529 | S | 5/1990 | Baetens | |
| 4,966,297 | A | 10/1990 | Doty | |
| 4,989,742 | A * | 2/1991 | Powell | 220/23.4 |
| 5,060,820 | A | 10/1991 | Boerner | |
| 5,085,391 | A | 2/1992 | Berger et al. | |
| 5,119,967 | A | 6/1992 | Ercolani | |
| 5,294,000 | A | 3/1994 | Yanuzzi | |
| 5,346,070 | A | 9/1994 | McSpadden | |
| D352,367 | S | 11/1994 | Gryzlak | |
| D359,885 | S | 7/1995 | Yanuzzi | |
| 5,542,577 | A | 8/1996 | Friedrich | |
| D373,933 | S | 9/1996 | Gibbs, III | |
| 5,551,593 | A | 9/1996 | Wiens | |
| 5,662,240 | A | 9/1997 | Norris | |
| D388,661 | S | 1/1998 | Vignau et al. | |
| D402,509 | S | 12/1998 | Indekeu | |
| 5,947,011 | A | 9/1999 | Xu | |
| D415,930 | S | 11/1999 | Schmidt | |
| 6,021,914 | A | 2/2000 | Schmidt | |
| D430,458 | S | 9/2000 | Kellermann | |
| D455,050 | S | 4/2002 | Tyler et al. | |
| D472,768 | S | 4/2003 | Wellner | |

(Continued)

OTHER PUBLICATIONS

Wavetrends Clear Plastic Cocktail Plate with Stemware Hole, available at www.webrestaurantstore.com/wavetrends-clear-plastic-cocktail-plate-with-stemware-hole . . . .

(Continued)

*Primary Examiner* — Anthony Stashick
*Assistant Examiner* — Robert Poon
(74) *Attorney, Agent, or Firm* — Edward J. Baba; Daniel G. Stoddard; Bozicevic, Field & Francis LLP

(57) ABSTRACT

A plate that is designed to be held in one hand of a user together with a drinking glass.

15 Claims, 5 Drawing Sheets

(56) References Cited

U.S. PATENT DOCUMENTS

| | | | |
|---|---|---|---|
| D473,757 | S | 4/2003 | Schwartz |
| 6,609,325 | B2 | 8/2003 | Harris |
| 6,609,625 | B1 | 8/2003 | Gibbar |
| 6,691,890 | B1 | 2/2004 | Persson |
| 6,702,141 | B1 | 3/2004 | Cinque |
| 7,000,799 | B1 | 2/2006 | Hamre |
| D537,679 | S | 3/2007 | Majka |
| D559,615 | S | 1/2008 | Laib |
| D588,879 | S | 3/2009 | Brett |
| D594,281 | S | 6/2009 | Luft |
| D594,705 | S | 6/2009 | McComas |
| D595,093 | S | 6/2009 | McComas |
| 7,543,869 | B2 | 6/2009 | Davis |
| D626,788 | S | 11/2010 | Clark |
| D650,237 | S | 12/2011 | McComas |
| D653,085 | S | 1/2012 | Swallow |
| 8,136,667 | B2 | 3/2012 | Raynor |
| 2004/0099670 | A1* | 5/2004 | Michaeli ..... 220/574 |
| 2005/0161453 | A1 | 7/2005 | Corrieri |
| 2006/0266748 | A1 | 11/2006 | Crawford |
| 2009/0152157 | A1 | 6/2009 | Schaaper et al. |
| 2012/0000915 | A1 | 1/2012 | Swallow |

OTHER PUBLICATIONS

International Search Report of International Application No. PCT/US2012/047325, dated Oct. 17, 2012.

* cited by examiner

COCKTAIL PLATE

This invention pertains to a plate that is designed to be held in one hand of a user together with a drinking glass.

BRIEF DESCRIPTION OF THE DRAWINGS

The following drawings illustrate the concepts of the present invention and are not necessarily drawn to scale.

DETAILED DESCRIPTION OF SOME EMBODIMENTS

Figure 1:
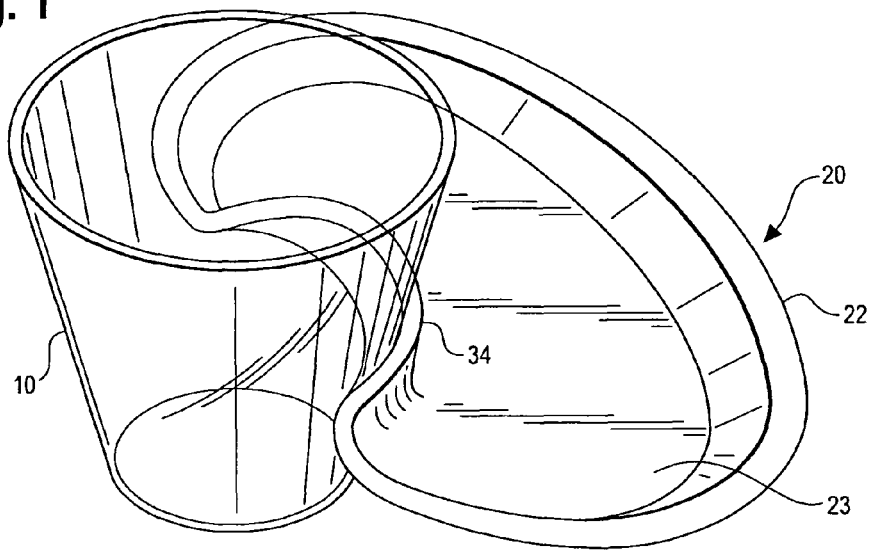
FIG. 1 is a perspective view of one embodiment of the plate shown next to a drinking glass, as the plate might be used.

While the present invention is susceptible of embodiment in various forms, there is shown in the drawings and will hereinafter be described some of the embodiments with the understanding that the present disclosure is to be considered an exemplification of the invention and is not intended to limit the invention to the specific embodiments illustrated or described.

The present invention provides novel and elegant solution to the problem of holding a plate in one hand together with a drinking glass while leaving the other hand free for other purposes, such as shaking hands, lifting food from the plate, and so forth. "Drinking glass" is used throughout the specification and claims to refer to any glass or cup of any kind or composition, an intended use of which is for a user to drink directly from the drinking glass a liquid contained in the drinking glass.

Figure 2:
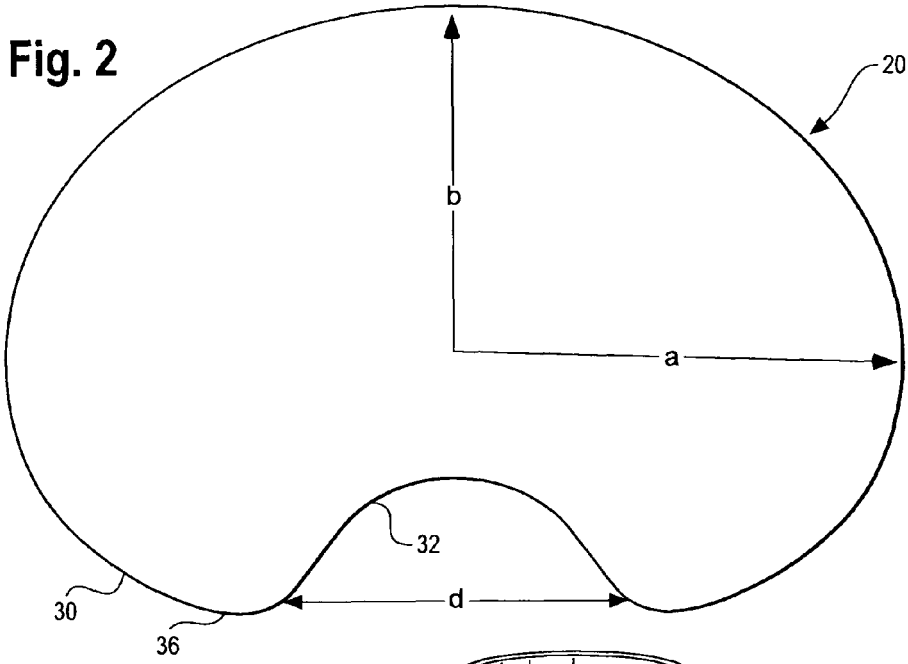
FIG. 2 is a top view of the plate shown in FIG. 1.
Figure 6:
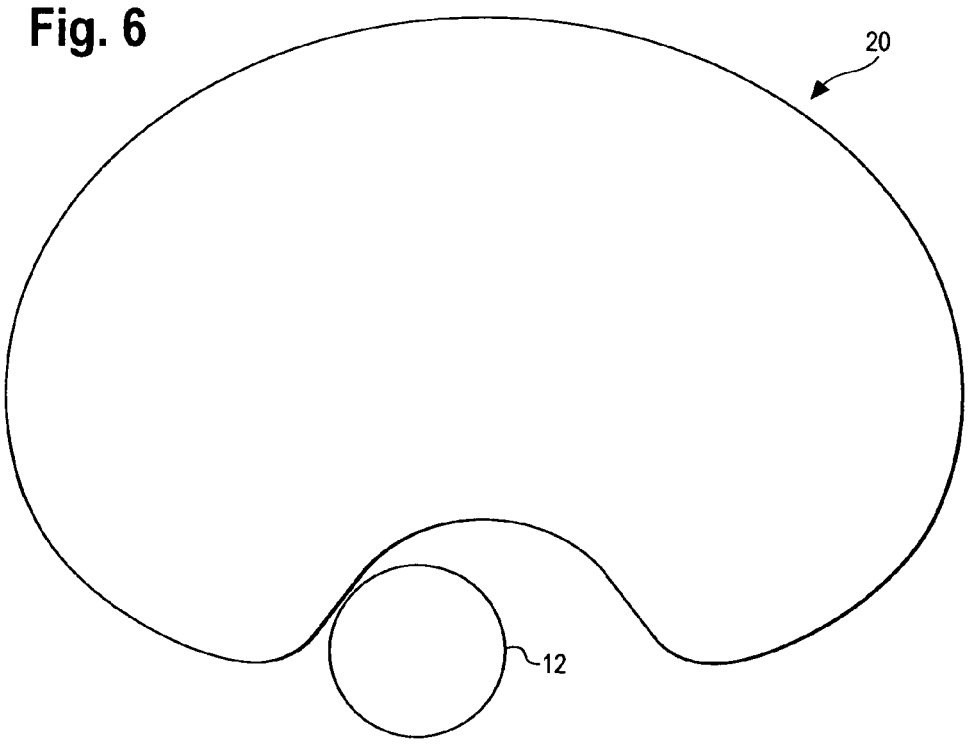
FIG. 6 is a top view of the plate shown in FIG. 1, shown next to a drinking glass with a smaller diameter than the drinking glass of FIG. 1.
Figure 7A:
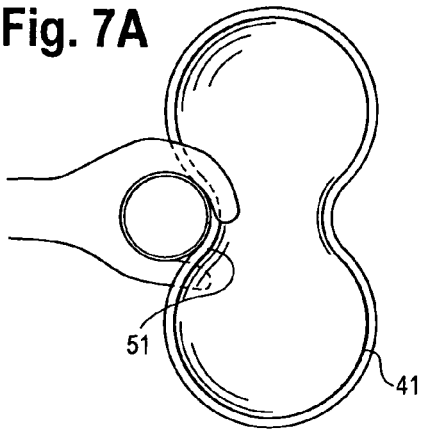
FIGS. 7A-7H are top views of different embodiments of the plate, respectively, each shown being held in one hand of a user together with a drinking glass.
Figure 7B:
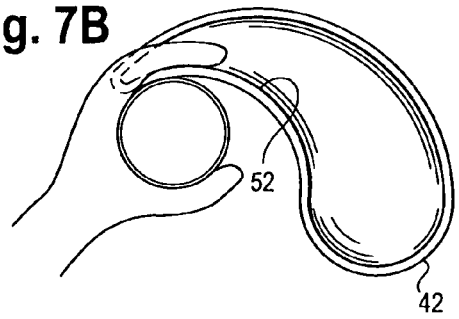
Figure 7C:
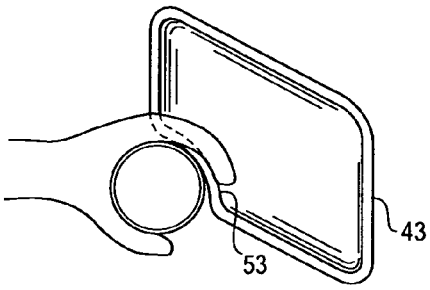
Figure 7D:
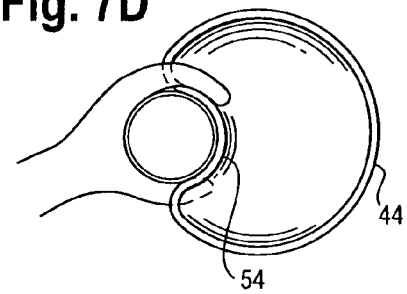
Figure 7E:
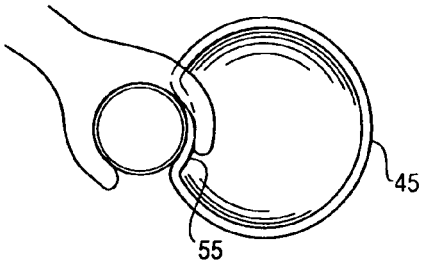
Figure 7F:
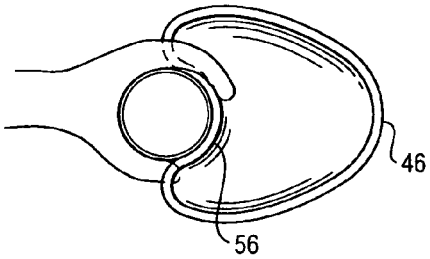
Figure 7G:
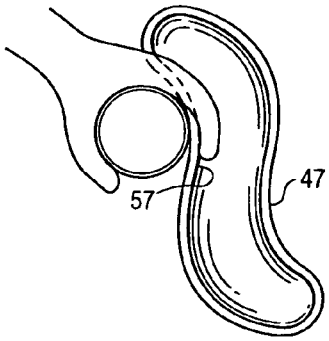
Figure 7H:
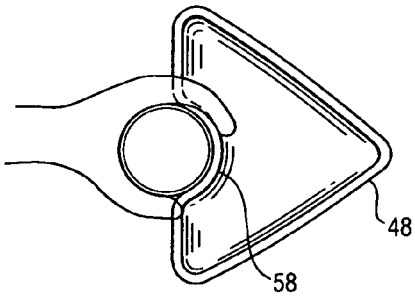

FIG. 1 is a perspective view of one embodiment of the plate 20 shown next to a drinking glass 10. A top view of plate 20 is illustrated in FIG. 2. The periphery 30 includes an incurvate portion 32 that curves inward. While the incurvate portion 32 corresponds generally with an arc, the curvature of the incurvate portion 32 may vary over its length. Indeed, some parts of the incurvate portion may be straight in some embodiments. For example, FIGS. 7A-7H show variously shaped embodiments 41-48 of the plate, respectively, each having differently curved incurvate portions 51-58. However, an arc generally corresponding with the entire incurvate portion should extend no more than about 180° (i.e., no more than about a semi-circle). In this way, the incurvate portion of the periphery 30 of a particular plate can be sized to be held comfortably against drinking glasses of different shapes and diameters. For example, FIG. 6 illustrates an example of plate 20 being held against a drinking glass 12 with a smaller diameter than the drinking glass 10 of FIG. 1, and FIGS. 7B and 7G illustrate other examples of plates 42 and 47 being held against drinking glasses that are smaller than might fit against incurvate portions 52 or 57.

In all embodiments, a drinking glass is not attached to a plate and does not rest on a plate or in an opening through a plate. Rather, a plate is shaped, for example, to facilitate holding a drinking glass, of any practical diameter, against an incurvate portion of a periphery of the plate, where both the drinking glass and the plate can be held in one hand. While the incurvate portion might, in some embodiments, extend around a little more than a semi-circle, further extension around would limit the sizes and shapes of drinking glasses that could be brought up against the incurvate portion and held comfortably together with the plate in one hand.

In the example of FIG. 1, all of the incurvate portion 32 includes a raised edge 34 that is elevated in relation to an edge 36 of a portion of the periphery 30 that is immediately adjacent to the incurvate portion 32. A user's forefinger then can fit over an edge 36 of an immediately adjacent portion of the periphery 30 and along an inside surface of the raised edge 34. In this way, the plate 20 can be held in one hand together with a drinking glass 10, with an outside surface of the raised edge 34 and the drinking glass 10 being pressed against each other. The drinking glass 10 does not rest on the plate 20, per se. Rather, the drinking glass 10 and the plate 20 are both being held together in the same hand. The outside surface of the raised edge 34 and the drinking glass 10 are being pressed against each other, with the thumb around the drinking glass 10 and the forefinger along an inside surface of the raised edge 34. Other fingers fit underneath the plate 20 (and possibly around the drinking glass 10), and might help support the weight of the plate 20 and possibly the drinking glass 10.

Figure 3:
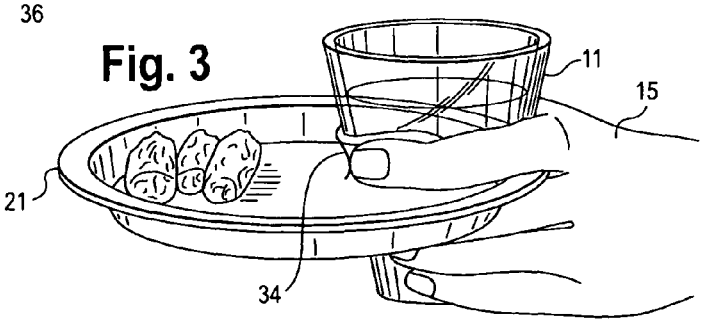
FIG. 3 is a perspective view of another embodiment of the plate, shown being held in one hand of a user together with a drinking glass.
Figure 4:
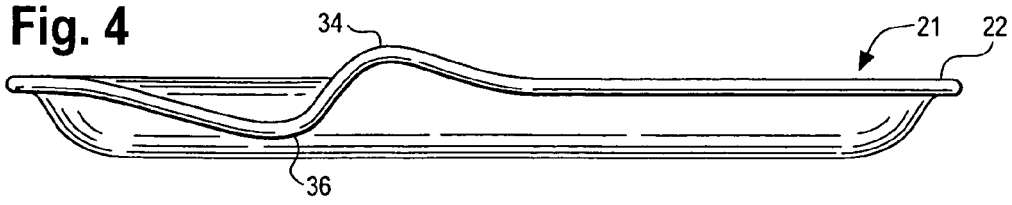
FIG. 4 is a side view of the plate shown in FIG. 3.
Figure 5:
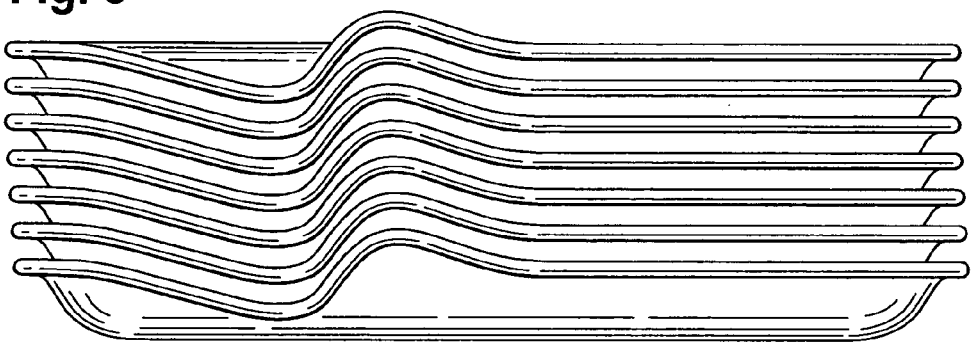
FIG. 5 is side view of a stack of plates, like the plate shown in FIG. 3.
Figure 8:
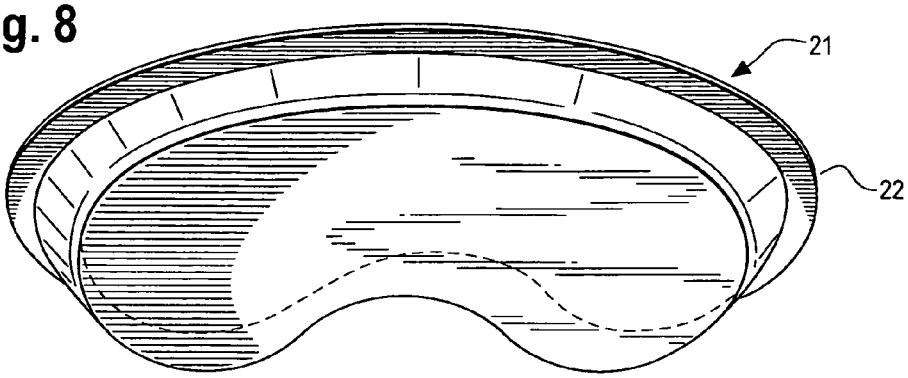
FIG. 8 is a bottom perspective view of the plate shown in FIGS. 3 and 4.

In FIG. 1, the raised edge 34 exists at the left-most and the right-most parts of the incurvate portion 32, and is elevated in relation to the edge 36 in portions of the periphery 30 immediately to the left and right of the incurvate portion 32. In that embodiment, the plate 20 is as functional for being held in either a left hand or a right hand together with a drinking glass 10. Other embodiments may be designed for use by only a left hand or by only a right hand. For example, FIG. 3 is a perspective view of plate 21 being held in a left hand 15 of a user together with a drinking glass 11. FIG. 4 shows a side view of plate 21, and FIG. 5 shows a stack of plates 21. FIG. 8 shows a bottom perspective view of the plate shown in FIGS. 3 and 4. Plate 21 is shaped like plate 20, except that a raised edge 34 is highest at the left-most part of the incurvate portion which is elevated in particular in relation to the edge 36 in the portion of the periphery immediately to the left of the incurvate portion.

As best seen in FIGS. 1 and 4, some embodiments include a raised lip 22 along most of the periphery 30 (excluding the incurvate portion 32 and the edge 36 in the portions of the periphery immediately to the left or right of the incurvate portion 32) and, in some embodiments, extending outwardly in directions generally parallel to and away from a central food-receiving surface 23 of the plate 20. By contrast, in at least some embodiments, an outside surface of the raised edge 34 of the incurvate portion 32 does not extend outwardly, and may lean inwardly as it rises to accommodate more easily drinking glasses with greater diameters near the top of the drinking glass than near the bottom.

In some embodiments, the raised edge 34 of the incurvate portion 32 is elevated in relation to the raised lip 22, and the raised lip 22 is elevated in relation to the edge 36 in portions of the periphery 30 immediately to the left and right of the incurvate portion 32. In the example of FIGS. 3, 4, 5 and 8, plate 21 is a "left-handed" plate, and the raised lip 22 is elevated only in relation to the edge 36 in the portion of the periphery 30 that is immediately to the left of the incurvate portion 32.

Figure 9:
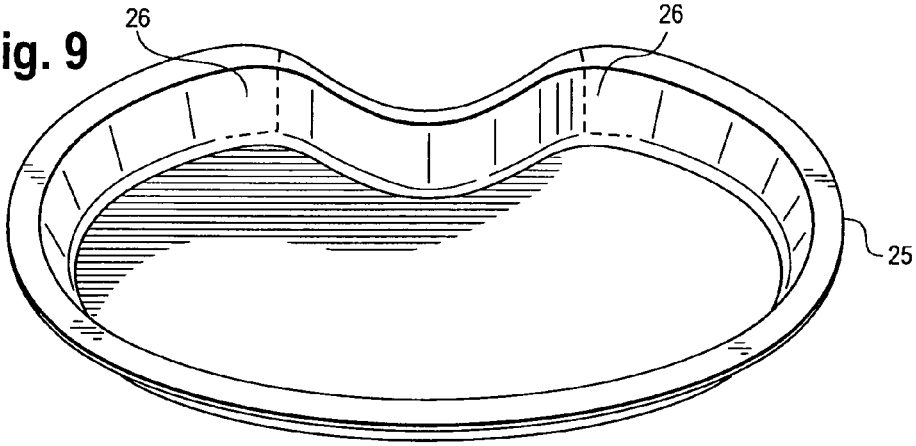
FIG. 9 is a perspective view of another embodiment of the plate.
Figure 10:
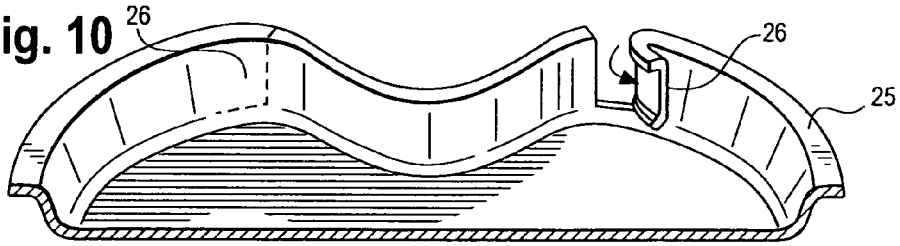
FIG. 10 is a partial perspective view of the plate shown in FIG. 9, with a finger slot moved open.
Figure 11:
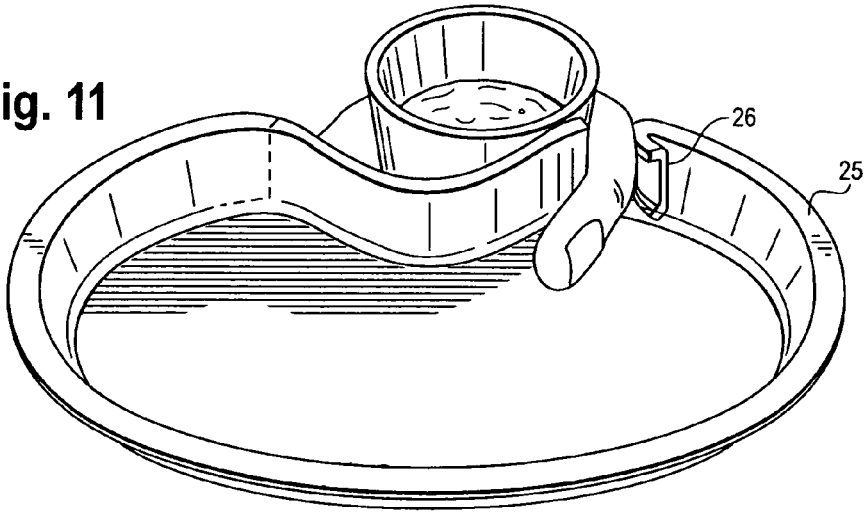
FIG. 11 is a perspective view of the plate of FIG. 9 shown with a finger in an open finger slot.
Figure 12:
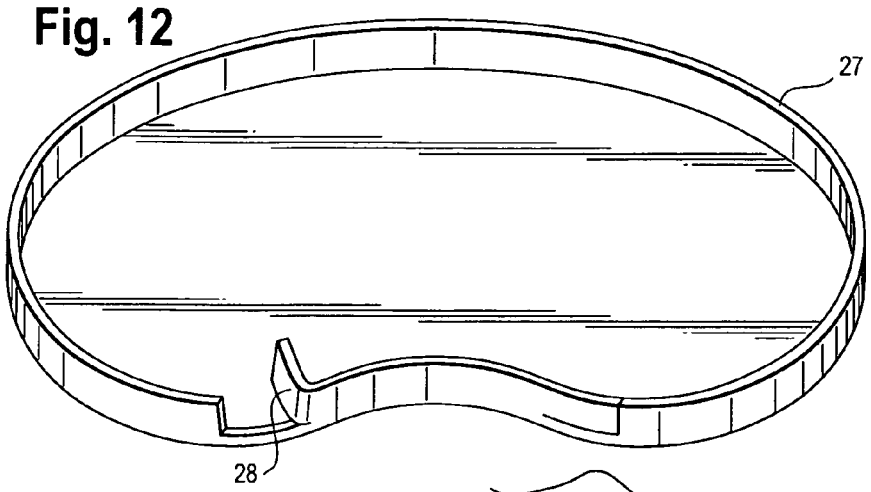
FIG. 12 is a perspective view of another embodiment of the plate.
Figure 13:
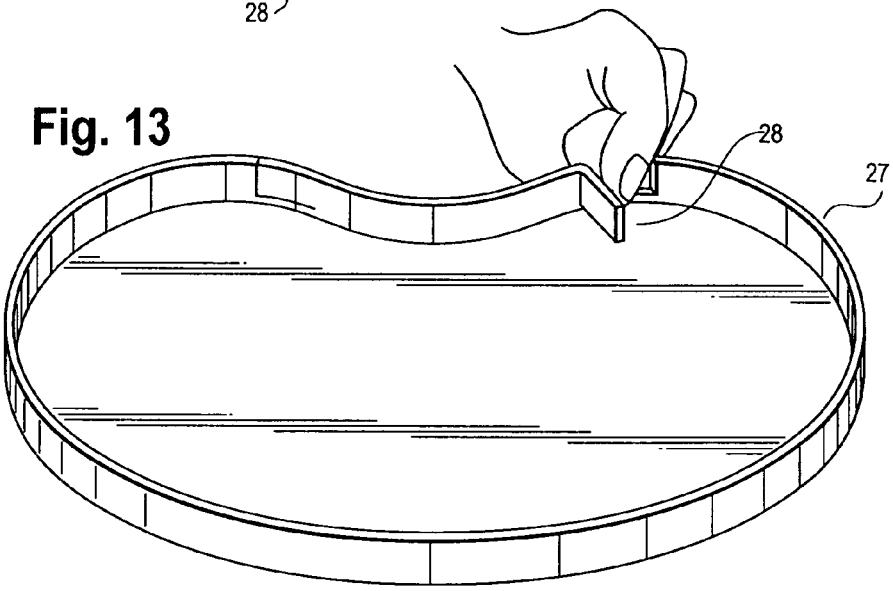
FIG. 13 is a perspective view of the plate shown in FIG. 12, with a finger slot moved open.
Figure 14:
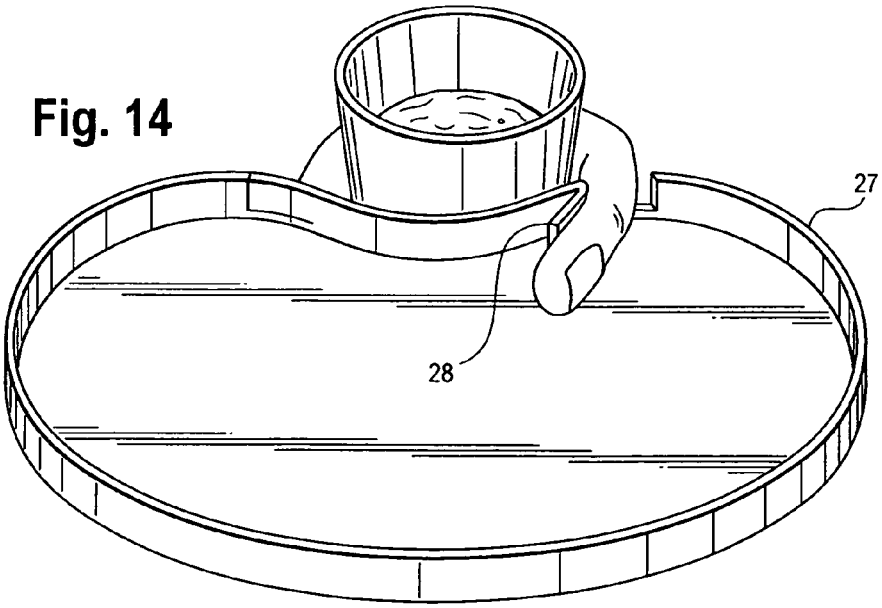
FIG. 14 is a perspective view of the plate of FIG. 12 shown with a finger in an open finger slot.

FIG. 9 shows a perspective view of a plate 25, in which the portions of the periphery immediately to the left and right of the incurvate portion are raised and include movable parts 26 that may be moved open to create finger slots. In FIG. 10, one of the parts 26 is shown in the "open" state so that a finger may fit through the finger slot and along the inside surface of the raised edge of the incurvate portion, as illustrated in FIG. 11. Similarly, FIGS. 12-14 show a plate 27 with a movable part 28 that opens in the opposite direction as the moveable part 26 in the embodiment of FIGS. 9-11.

As seen in the examples of plates 41-48 in FIGS. 7A-7H, the periphery of the plate can be of various shapes and dimensions as long as there is an incurvate portion 51-58 that can be pressed against a drinking glass. For example, the periphery may be generally circular, triangular, tear-drop shaped, parallelogram-shaped, etc. In the embodiment of FIGS. 1 and 2, the periphery 30 is generally oval in shape except for the incurvate portion 32. The center of mass of plate 20 is located closer to a point in the incurvate portion 32 than to any other point in the periphery 30. In a preferred embodiment illustrated in FIG. 2, the oval shape of the periphery 30 corresponds generally with an ellipse, with a ratio of its semi-major axis "a" to its semi-minor axis "b" of between about 1.4 and about 1.5. In FIG. 2, the shortest distance between any two points, respectively, in the portions of the periphery 30 immediately to the left and right of the incurvate portion 32 is labeled as the linear distance "d". In a preferred embodiment of FIG. 2, a ratio of the linear distance "d" to the semi-minor axis "b" is between about 1.25 and about 1.30.

Various features of different examples are disclosed and may be interchanged and used in different examples than the examples with which they were discussed. Numerous modifications and variations can be effectuated without departing from the true spirit and scope of the novel concepts of the present invention. It is to be understood that no limitation with respect to the specific embodiments illustrated or described is intended or should be inferred.

The invention claimed is:

1. A plate comprising:

a base comprising a peripheral wall and a raised lip along most of the peripheral wall around a central food-receiving surface;

the peripheral wall comprising an incurvate end portion and left and right immediately adjacent portions;

the incurvate end portion comprising left and right parts and defining an outer peripheral portion of the plate;

the left part of the incurvate end portion being immediately adjacent to the left immediately adjacent portion of the peripheral wall;

the right part of the incurvate end portion being immediately adjacent to the right immediately adjacent portion of the peripheral wall;

the incurvate end portion extends no more than 180° from an outer peripheral portion of the left immediately adjacent portion of the peripheral wall to an outer peripheral portion of the right immediately adjacent portion of the peripheral wall;

at least one of the left and right parts comprising a raised edge;

the raised edge comprising an inside surface facing the central food-receiving surface of the base;

the raised edge comprising an outside surface facing away from the central food-receiving surface of the base;

the raised edge being elevated in relation to a respective edge of at least one of the left and right immediately adjacent portions that is immediately adjacent to the raised edge, and in relation to the raised lip; and the raised lip being elevated in relation to at least one of the left and right parts.

2. The plate as in claim 1, the plate having a center of mass that is located closer to a point in the incurvate portion than to any other point in the peripheral wall.

3. The plate as in claim 1, wherein each of the left and right parts of the incurvate portion comprising the raised edge;

the raised edge of the left part being elevated in relation to the edge of the left immediately adjacent portion; and the raised edge of the right part being elevated in relation to the edge of the right immediately adjacent portion.

4. The plate as in claim 1, a top of the raised lip extending outwardly in directions generally parallel to the central food-receiving surface.

5. The plate as in claim 1, the raised lip being elevated in relation to the edges of both of the left and right immediately adjacent portions.

6. The plate as in claim 1, the raised edge of both the left and right parts of the incurvate portion being elevated in relation to the raised lip.

7. The plate as in claim 6, the raised lip being elevated in relation to the edges of both of the left and right immediately adjacent portions.

8. The plate as in claim 1, the outside surface of the raised edge leaning inwardly as it rises.

9. The plate as in claim 1, the peripheral wall being generally oval in shape except for the incurvate portion.

10. The plate as in claim 9, wherein the oval shape of the peripheral wall corresponds generally with an ellipse;

a ratio of a semi-major axis to a semi-minor axis of the ellipse is between about 1.4 and about 1.5.

11. The plate as in claim 10, wherein a linear distance "d" is the shortest distance between any two points, respectively, in the left and right immediately adjacent portions of the peripheral wall;

a ratio of the linear distance "d" to the semi-minor axis is between about 1.25 and about 1.30.

12. The plate as in claim 1, the peripheral wall being generally triangular in shape except for the incurvate portion.

13. The plate as in claim 1, the peripheral wall being generally parallelogram-shaped except for the incurvate portion.

14. The plate as in claim 1, the peripheral wall being generally tear-dropped in shape.

15. The plate as in claim 1, the peripheral wall being generally circular in shape except for the incurvate portion.

* * * * *